US007325334B2

(12) United States Patent
Lebo

(10) Patent No.: US 7,325,334 B2
(45) Date of Patent: Feb. 5, 2008

(54) METHOD AND APPARATUS FOR PROVIDING A SHOE WITH IMPROVED STRUCTURAL INTEGRITY

(75) Inventor: Jonathan K. Lebo, Lebanon, PA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 10/293,744

(22) Filed: Nov. 13, 2002

(65) Prior Publication Data

US 2004/0088884 A1 May 13, 2004

(51) Int. Cl.
*A43B 13/28* (2006.01)

(52) U.S. Cl. ..... 36/24.5; 36/35 A

(58) Field of Classification Search ..... 36/24.5, 36/34 R, 35 A, 34 A, 42, 17 A, 18, 22 R
See application file for complete search history.

(56) References Cited

U.S. PATENT DOCUMENTS

| | | | | | |
|---|---|---|---|---|---|
| 156,136 | A * | 10/1874 | Childs et al. | ..... | 36/14 |
| 2,347,762 | A * | 5/1944 | Bergman | ..... | 36/13 |
| RE22,695 | E * | 11/1945 | Fern | ..... | 36/19.5 |
| 3,273,263 | A * | 9/1966 | Klima | ..... | 36/87 |
| 4,219,946 | A * | 9/1980 | Baum | ..... | 36/42 |
| 4,409,745 | A * | 10/1983 | Musci | ..... | 36/24.5 |
| 4,685,223 | A | 8/1987 | Long | ..... | 36/16 |
| 4,852,275 | A | 8/1989 | Bianchini et al. | ..... | 36/102 |
| 4,908,964 | A | 3/1990 | Deem | ..... | 36/88 |
| 5,893,186 | A | 4/1999 | Issler et al. | ..... | 12/146 |
| 5,974,697 | A | 11/1999 | Tseng | ..... | 36/77 R |
| 6,029,301 | A | 2/2000 | Issler et al. | ..... | 12/142 B |
| 6,067,732 | A | 5/2000 | Dodge | ..... | 36/77 R |
| 6,115,946 | A | 9/2000 | Morris et al. | ..... | 36/115 |
| 6,145,220 | A | 11/2000 | Johnson, Jr. et al. | ..... | 36/34 R |
| 6,282,818 | B1 * | 9/2001 | Lu | ..... | 36/110 |
| 6,360,455 | B1 | 3/2002 | Seo | ..... | 36/61 |
| 6,519,878 | B2 * | 2/2003 | Yoshiaki | ..... | 36/132 |

* cited by examiner

*Primary Examiner*—Ted Kavanaugh
(74) *Attorney, Agent, or Firm*—St. Onge Steward Johnston & Reens LLC

(57) ABSTRACT

The invention includes a method and apparatus for providing a shoe having an outsole with a top surface and a bottom surface, an anchoring mechanism placed between the top surface and the bottom surface, an upper connected to the outsole, and a fastener extending from the upper to the anchoring mechanism for securing the upper to the outsole.

16 Claims, 11 Drawing Sheets

METHOD AND APPARATUS FOR PROVIDING A SHOE WITH IMPROVED STRUCTURAL INTEGRITY

FIELD OF THE INVENTION

The invention relates to a shoe having improved integrity in the outsole for providing a structure to which an upper is secured. By providing a better union between the upper and outsole, the overall structural integrity of the shoe is also improved.

BACKGROUND OF THE INVENTION

Shoes may be constructed according to any one of several different types of constructions known in the art.

One type of construction, often referred to as an Opanka construction, typically includes sewing the outsole to the upper of the shoe along the entire outer periphery of the outsole. Because the outsole is generally made of rubber or other flexible material, the outsole normally provides some level of comfort and permits an awl to penetrate the outsole to sew the upper to the outsole.

Another type of construction usually entails cementing, or gluing, the outsole to a lasted upper. A further method for constructing a shoe commonly includes a combination of sewing and cementing, where the forepart of the upper is typically sewn to the forepart of the outsole and the rear part of the upper, which is typically lasted, is cemented to the rear part of the outsole.

Another type of shoe construction, often found in shoes having heels such as dress shoes, may include the use of fasteners, such as nails, rivets, or screws, to fasten the heel to the outsole. Fasteners normally have a pointed end that is driven downwardly through a tuck, which is typically in contact with the upper after the upper has been lasted, and into the heel. A possible disadvantage of using fasteners to secure the heel to the outsole is that the outsole, because it is typically of rubber or other flexible material, does not provide sufficient integrity for anchoring the fasteners. As a result, the upper may separate from the outsole.

U.S. Pat. No. 6,360,455 to Seo appears to relate to an anchor plate lying in a channel on a top surface of an outsole and ay include a plurality of thru-holes for receiving fasteners. The fasteners may pass through the outsole and attach to a traction device that seems to be visibly located on the underside of the outsole (see FIG. 5).

U.S. Pat. No. 6,145,220 to Johnson appears to disclose a tuck for anchoring nails, which secure an insole, outsole, and upper to the tuck. The tuck seems to be of a rigid material and may be positioned on top of the insole on the inside but beneath a foam lining in the shoe.

U.S. Pat. No. 6,115,946 to Morris seems to disclose an anchor plate having threaded holes to receive fasteners, which secure a slide plate that may be positioned underneath the outsole to the anchor plate (see FIGS. 3 and 6). The anchor plate appears to sit on top of the midsole.

What is desired, therefore, is a shoe having improved structural integrity. What is also desired is a shoe construction that provides improved integrity to the outsole so that the upper may be adequately secured to the outsole. A further desire is an outsole that provides sufficient integrity to receive and anchor fasteners that secure the upper to the outsole.

SUMMARY OF THE INVENTION

Accordingly, it is an object of the invention to provide a shoe having improved structural integrity.

Another object of the invention is a shoe having an outsole with enhanced integrity so that the upper is securely connected to the outsole.

A further desire of the invention is a shoe having an outsole with the capability to receive and anchor fasteners that secure the upper to the outsole.

These and other objects of the invention are achieved by provision of a shoe having an outsole with a top surface and a bottom surface, an anchoring mechanism placed between the top surface and the bottom surface, an upper connected to the outsole, and a fastener extending from the upper to the anchoring mechanism for securing the upper to the outsole.

The outsole may also include a lip protruding upwardly from the top surface of the outsole and extending around at least one localized area of a periphery of the top surface for maintaining a position of the upper relative to the outsole. The localized area may be a front portion, back portion, or the entire periphery of the top surface.

In the preferred embodiment, the outsole forms an enclosure that completely encases the anchoring mechanism. In other embodiments, the outsole only partially encases the anchoring mechanism and in further embodiments, the anchoring mechanism is not encased at all.

Optionally, the top surface of the outsole may be bowed shape for defining a recess in the outsole for maintaining a position of the upper relative to the outsole.

In another aspect of the invention, a method for providing a shoe includes the steps of providing an outsole having a top surface and a bottom surface, placing an anchoring mechanism between the top surface and the bottom surface, and extending a fastener from the upper to the anchoring mechanism for connecting an upper to the outsole.

The method may also include the step of enclosing the outsole about the anchoring mechanism.

In further embodiments, the method may also include the step of protruding a lip upwardly from the top surface and extending the lip around at least one localized area of a periphery of the top surface for maintaining a position of the upper relative to the outsole. Similarly, in addition to or instead of providing the lip, the method may include the step of bowing the top surface for defining a recess in the outsole for maintaining a position of the upper relative to the outsole.

The invention and its particular features and advantages will become more apparent from the following detailed description considered with reference to the accompanying drawings.

BRIEF DESCRIPTION OF THE DRAWINGS

FIG. 9 shows the upper and the outsole unit of FIG. 8 turned inside in.

FIG. 14 shows the upper and the forepart of FIG. 13 turned inside in.

DETAILED DESCRIPTION OF THE DRAWINGS

Figure 1:
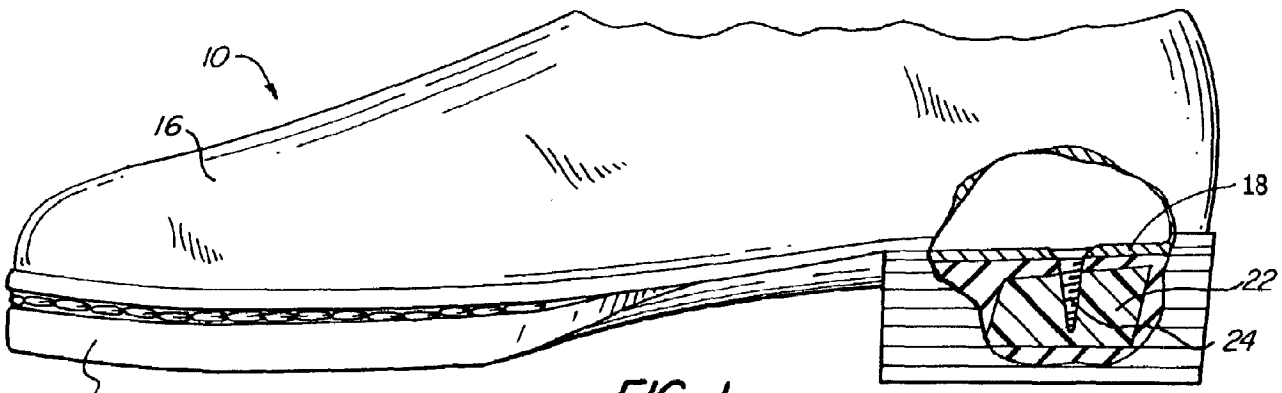
FIG. 1 depicts the shoe in accordance with the invention.

FIG.1 depicts the shoe 10 in accordance with the invention. Shoe 10 includes outsole 20, upper 16, anchoring mechanism 22, and fastener 24 for securing upper 16 to anchoring mechanism 22.

Figure 2:
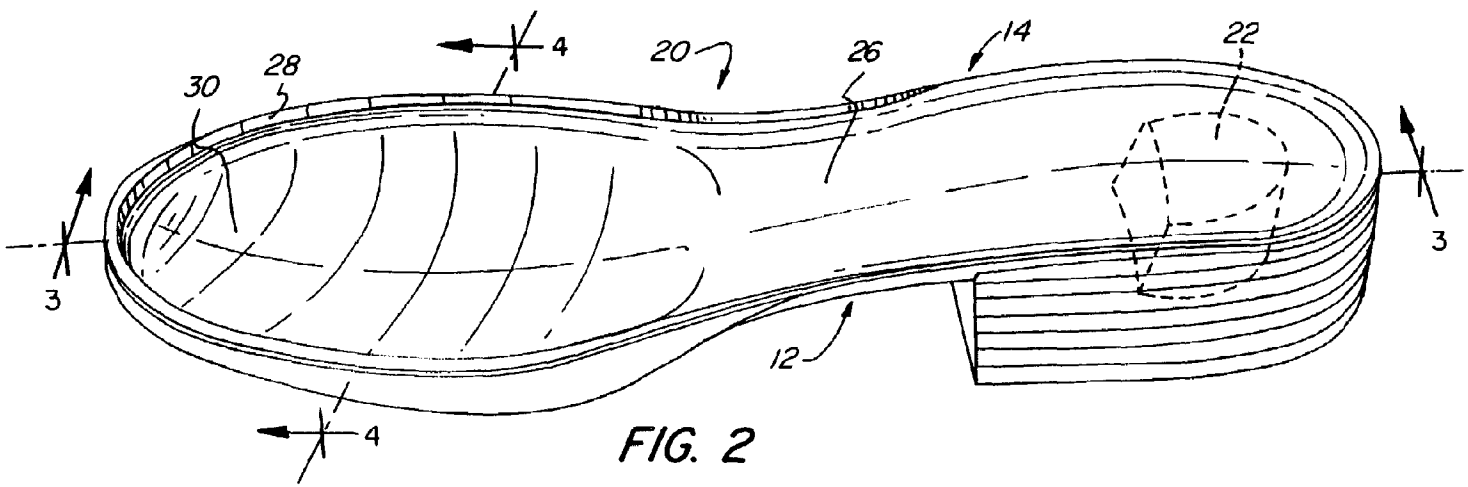
FIG. 2 depicts the outsole of the shoe in FIG. 1.

FIG. 2 more particularly depicts outsole 20, which further includes anchoring mechanism 22 in a heel or rearpart of outsole 20. Outsole 20 also includes recess 30 and lip 28.

Figure 3:
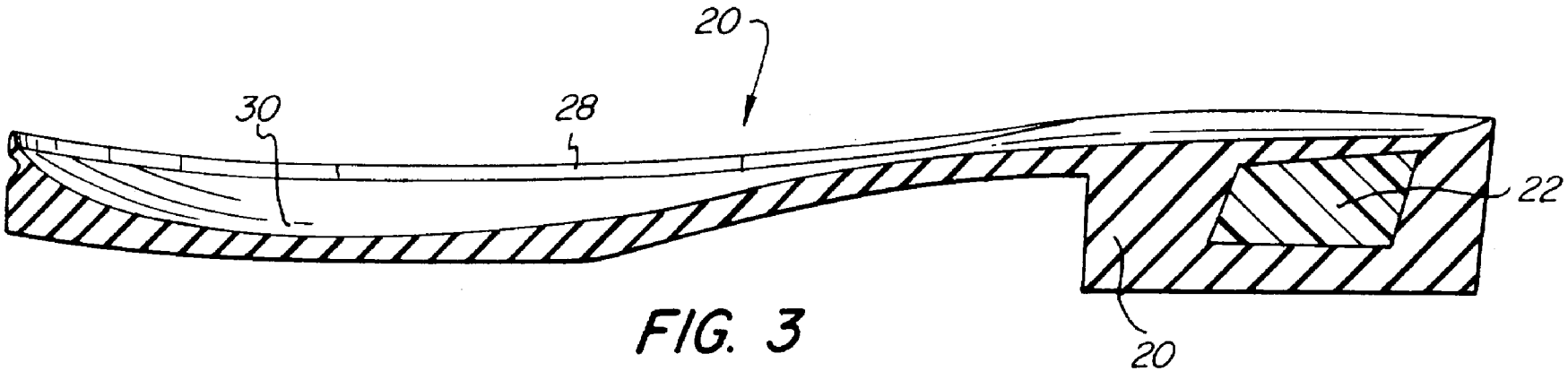
FIG. 3 depicts a cross sectional view of the outsole in FIG. 2.

FIG. 3 depicts a cross sectional view along a length of outsole 20 and shows anchoring mechanism 22 is placed completely within outsole 20 to secure upper 16 to anchoring mechanism 22. Referring to both FIGS. 1 and 3, fastener 24 normally secures upper 16 to anchoring mechanism 22 by penetrating into anchoring mechanism 22, such as a screw or nail.

In some embodiments, upper 16 includes a tuck 18 that extends underneath a user's foot and connects left side 12 of upper 16 to right side 14 of upper 16 (refer to both FIGS. 1 and 2). Tuck 18 is generally found on upper 16 that has been lasted. In these embodiments, fastener 24 penetrates through and fastens tuck 18 to anchoring mechanism 22. In other embodiments where upper 16 does not include tuck 18, such as moccasins, fastener 24 passes through and fastens upper 16 to anchoring mechanism 22.

For the purpose of simplicity, fastener 24 being described as securing upper 16 to anchoring mechanism 22 is understood to also include embodiments of a lasted upper where tuck 18, which is in contact with upper 16, is secured to anchoring mechanism 22.

Fastener 24 need not penetrate into anchoring mechanism 22 in order to adequately secure upper 16. Fastener 24 need only connect upper 16 to anchoring mechanism 22, such as being adhered or secured to the surface of anchoring mechanism 22. In these embodiments, adhering fastener 24 to the surface of anchoring mechanism 22 achieves the object of improved structural integrity of shoe 10 without penetrating into anchoring mechanism 22. Hence, the inventive feature is an anchoring mechanism 22 placed in outsole 20 to provide a structure to which upper 16 is fastened, regardless of how fastener 24 fastens upper 16 to anchoring mechanism 22. Fastener 24 is any mechanism that secures upper 16 to anchoring mechanism 22 and may be a screw, bolt, nail, rivet, nail, thread, adhesive, or the like.

As shown in FIGS. 1 and 2, anchoring mechanism 22 is completely encased within outsole 20. However, this is not required for shoe 10 to function properly. All that is required is for anchoring mechanism 22 to have sufficient integrity to improve the strength of the connection between upper 16 and anchoring mechanism 22 over the strength of the connection between upper 16 and outsole 20. Structural integrity is defined to be a measurable degree of the ability of a structure, in this case shoe 10, to maintain its form.

In other embodiments, anchoring mechanism 22 may be partially encased within outsole 20. In further embodiments, anchoring mechanism 22 may not be encased at all in outsole 20 but may be below or above outsole 20.

As shown, anchoring mechanism 22 is plastic but anchoring mechanism 22 may, in other embodiments, be made of wood, metal, or any other material or combination of materials that provides sufficient integrity to adequately secure upper 16 to outsole 20. Generally, anchoring mechanism 22 has more structural integrity than outsole 20.

Moreover, anchoring mechanism 22 is of a memory retaining material such that anchoring mechanism 22 may be threaded and, when fastener 24 is a screw, fastener 24 and upper 16 are held in place.

Figure 4:
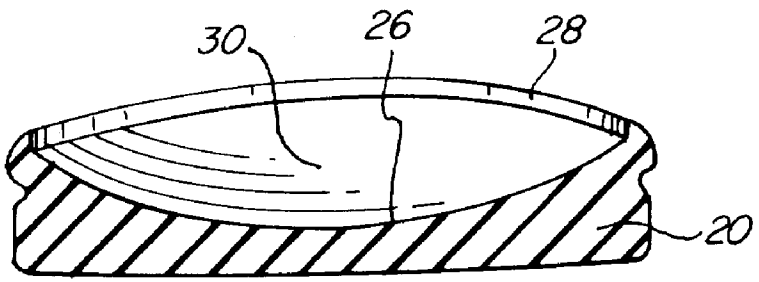
FIG. 4 depicts another cross sectional view of the outsole in FIG. 2.

FIGS. 2 and 4 depict a top surface 26 of outsole 20 where top surface 26 includes a raised lip 28 around a periphery of top surface 26. Top surface 26 is also bowed shape to define a recess 30, which is more particularly shown in the cross sectional view of FIG. 4. Both raised lip 28 and recess 30 help maintain a position of upper 16 and/or an insole relative to outsole 20.

Figure 5:
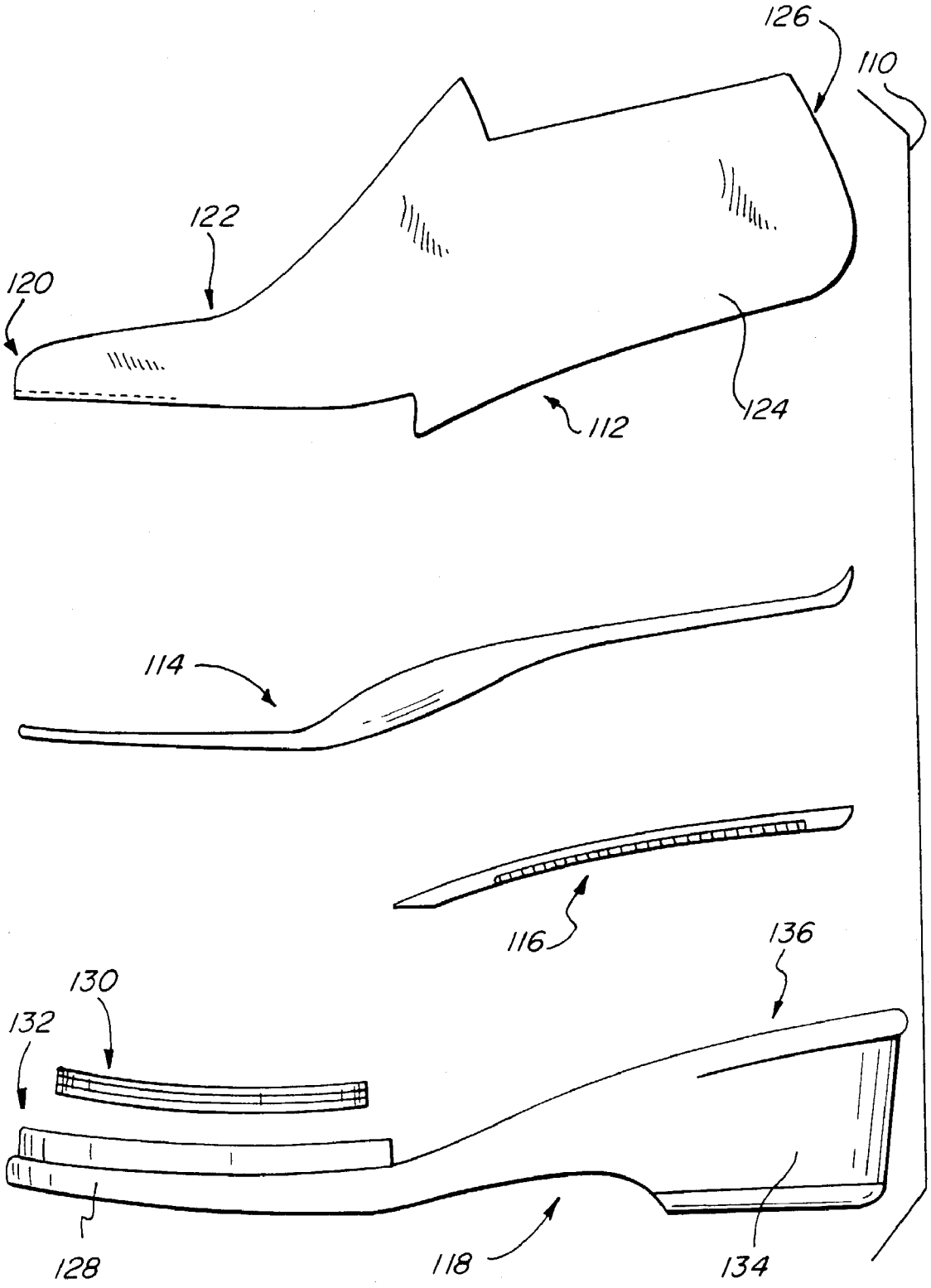
FIG. 5 is an exploded side view of the component parts of a shoe constructed in with a ¾ Opanka construction.

FIG. 5 shows a shoe 110 with ¾ Opanka construction that includes an upper 112, a footbed 114, a tuckboard 116, and an outsole unit 118.

The upper 112, preferably made of leather, cooperates with the outsole unit 118 to form an internal volume of the shoe 110. The upper 112 includes an inner liner (not shown) that is sewn to the inner surface of the upper 112. The inner liner is preferably made of soft leather to provide comfort to the wearer. The upper 112 also includes heat activated toe stiffener fitted and stitched inside a tip region 120 of the upper. The upper 112 is divided into a front portion 122 and a back portion 124. The front portion 122 includes the tip region 120 and extends back to about half the length of the upper, approximately where the arch of the wearer's foot would be located. The back portion 124 is the other half of the upper 112 and includes a lasting edge 126, which is lasted with a last (not shown) to gibe form to the back portion.

The outsole unit 118 includes an outsole 128, divided into a forepart 132 and a backpart 136 and preferably made of molded polyvinyl chloride, and a forepart filler 130, which is fitted into the forepart 132 of the outsole. A heel 134 is molded together with the outsole 128. The tuckboard 116 and the footbed 114 are disposed on top of the outsole unit 118. Heel 134 may also include anchoring mechanism 22, and the manner for securing upper 112 to heel 134 via fasteners 24, as described earlier under FIGS. 1-4.

Figure 6:
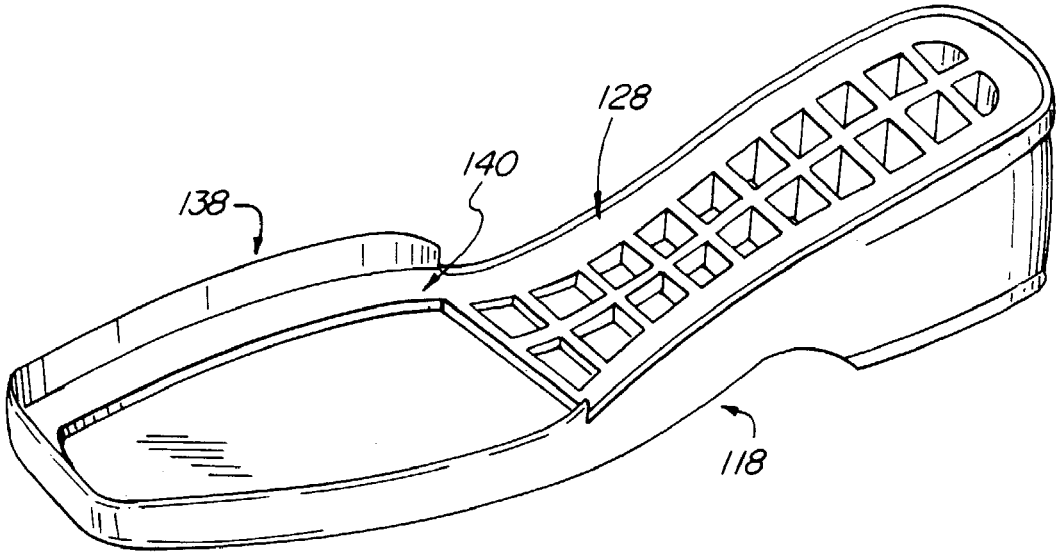
FIG. 6 shows an outsole unit of the shoe of FIG. 5.

Referring to FIG. 6, the outsole 128 has a standing lip 138 at the periphery of the forepart 132. The standing lip 138 has vertical grooves and stands approximately 7 mm from an adjacent pre-roughed base 140, which promotes adhesion of the vertically grooved lip to the base when the upper 112 is stitched to the outsole unit 118. The stitching process will be described in greater detail later. The standing lip 138 and the base 140 define a cavity into which the forepart filler 130 is to be fitted.

Figure 7A:
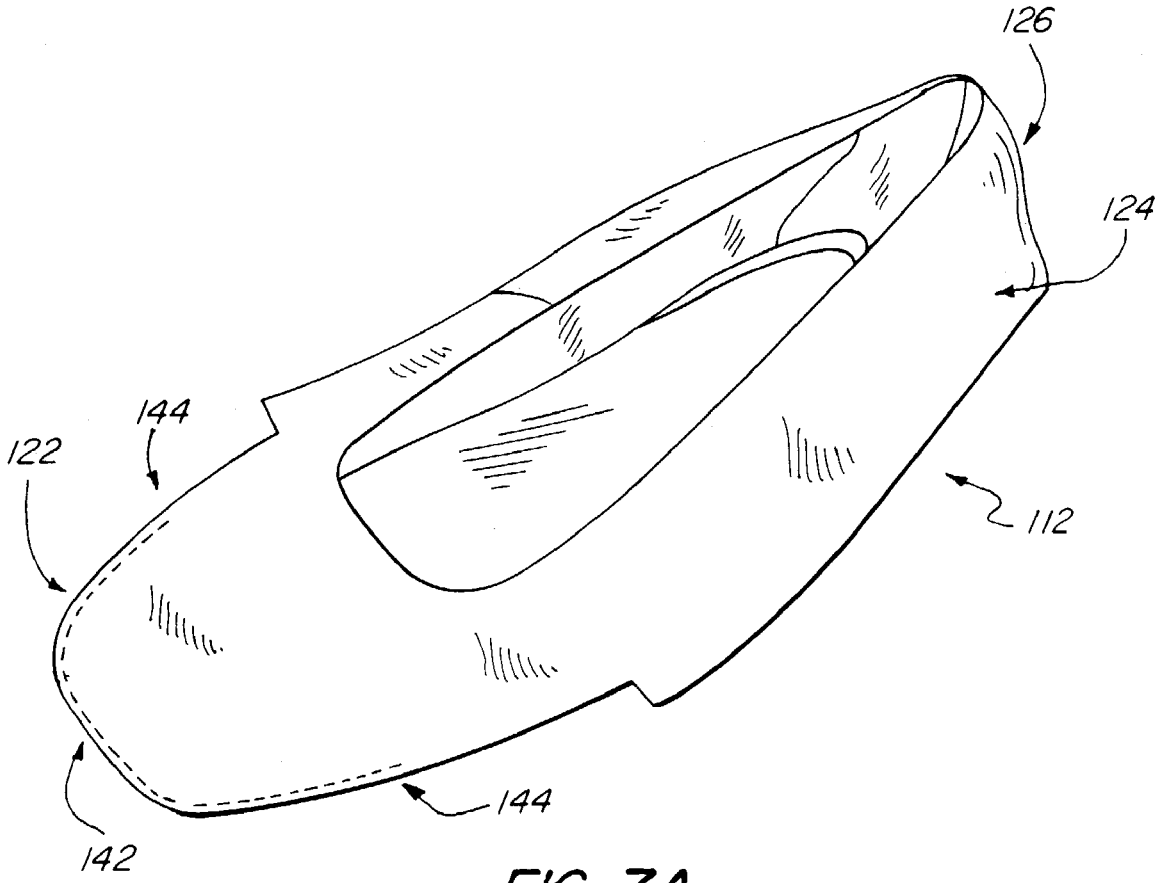
FIGS. 7A and 7B show an upper of the shoe of FIG. 5.
Figure 7B:
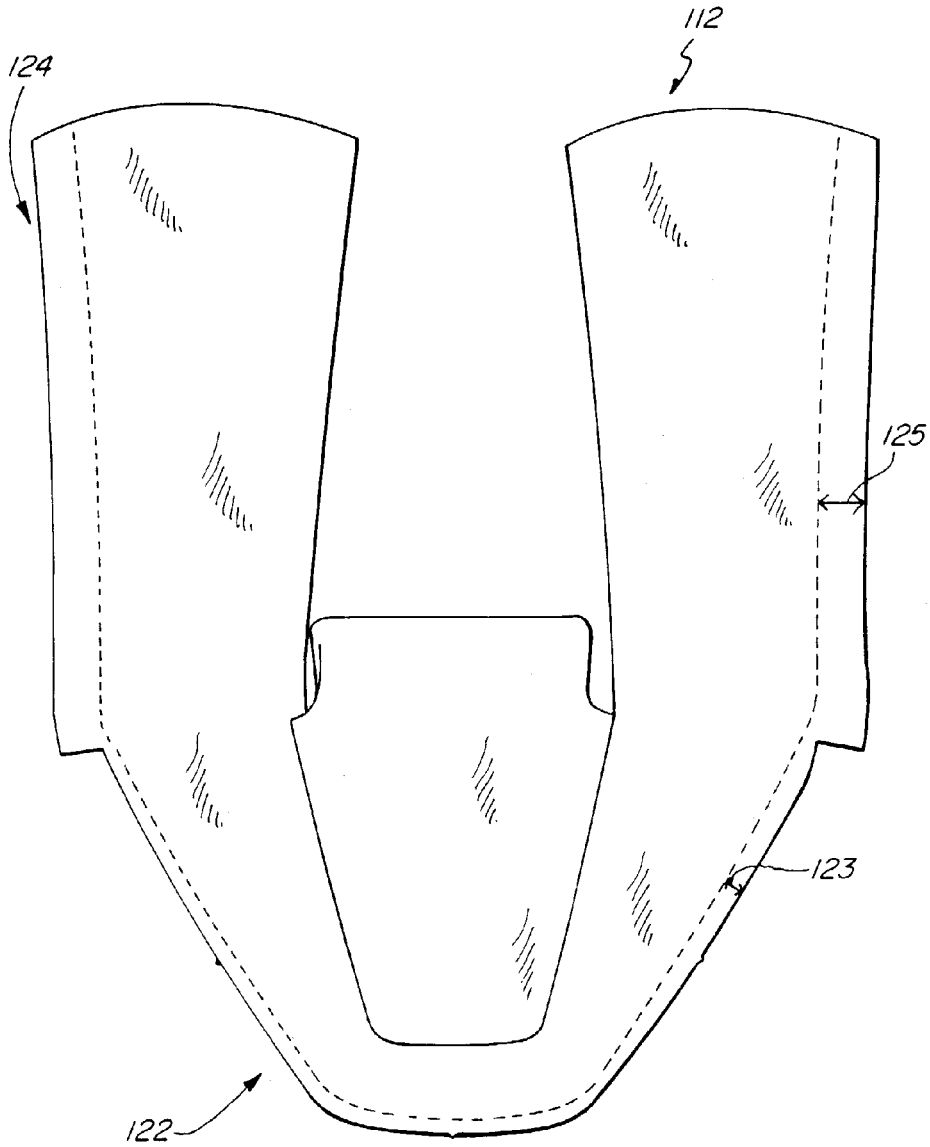

Referring to FIG. 7A, the upper 112 is shown to have a center mark 142 at the tip region 120 and two side arks 144 at the sides of the front portion 122 for guiding the stitching process. Referring to FIG. 7B, the front portion 122 of the upper 112 has a predetermined allowance 123, approximately 7 mm, for allowing the upper 112 and the outsole 128 to be stitched together inside out and then turned inside in after they are stitched together. The back portion 124 also has a predetermined allowance 125, approximately 15 m, for allowing the lasting edge 126 to be lasted.

A construction method of the shoe 110 will be described in connection with the figures.

Figure 8:
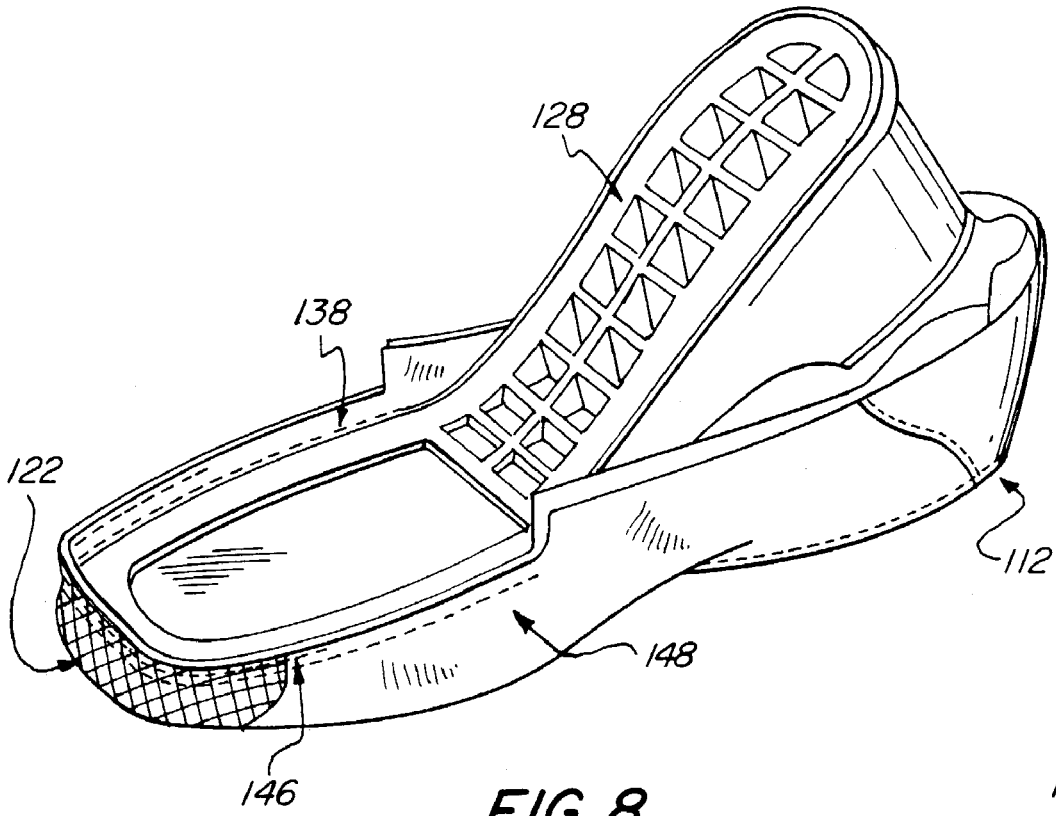
FIG. 8 shows an upper and an outsole unit attached inside out.

Referring to FIG. 8, the upper 112 is turned inside out and attached to the outsole 128 with the heel side facing the upper. The periphery of the front portion 122 of the upper is stitched to the standing lip 138 of the outsole. One row of stitching 146 is made from one side marker 144 to the other side marker 144, going around the periphery of the forepart 132 of the outsole 128. An additional row of stitching 148 is made from one lip end to the other lip end. The stitched lip 138 is then attached to the base 140.

Figure 9:
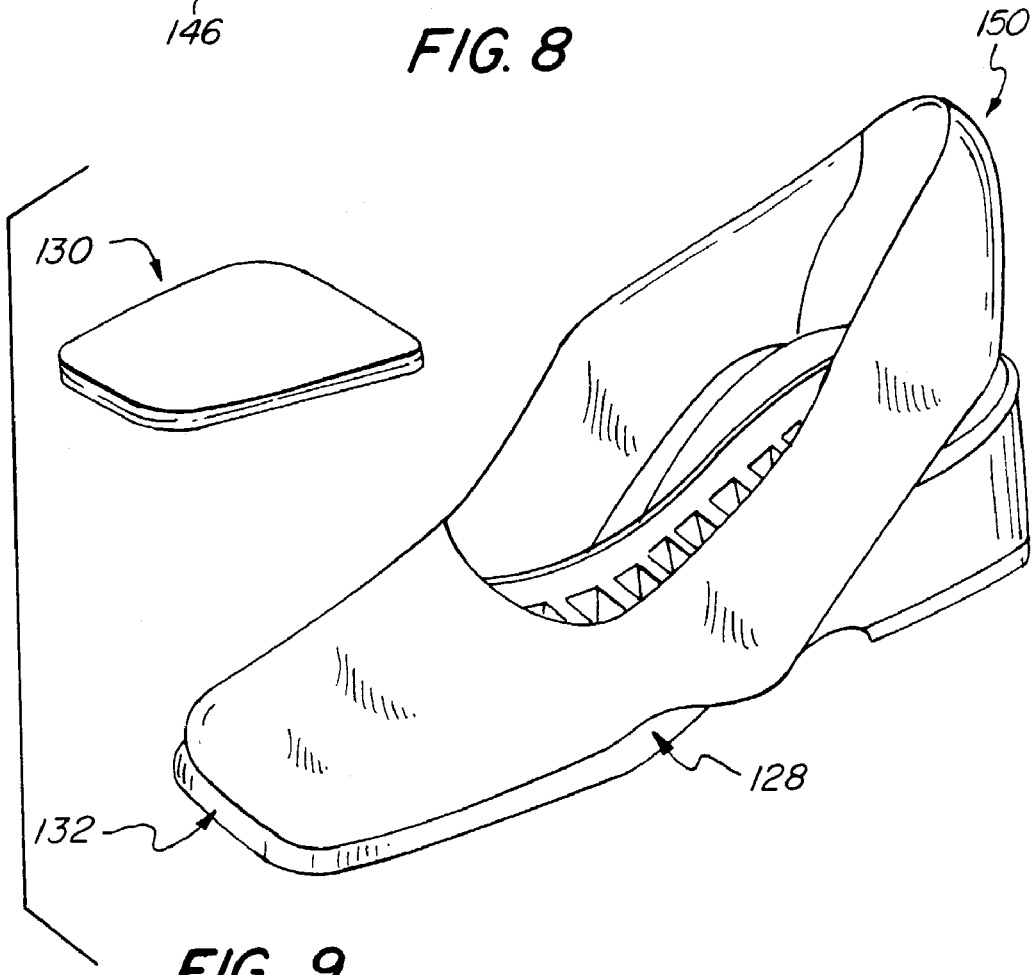

After the upper 112 is stitched to the outsole 128, the inside out configuration is turned inside in to obtain a turned upper configuration 150 as shown in FIG. 9. The forepart filler 130 is then inserted inside the turned upper configuration 150 and placed at the cavity of the forepart 132. The forepart filler 130 is preferably made of layers of "dry2, " cork and EVA copolymer, sold under the tradename Elvax by E.I. duPont de Nemours, Wilmington, Del.

Although not shown, a counter stiffener can be inserted into the upper 112 to provide structural support to the heel portion of the turned upper configuration 150. The counter stiffener is generally made of a thermoplastic material on a counter-forming machine using heating and cooling methods.

Figure 10:
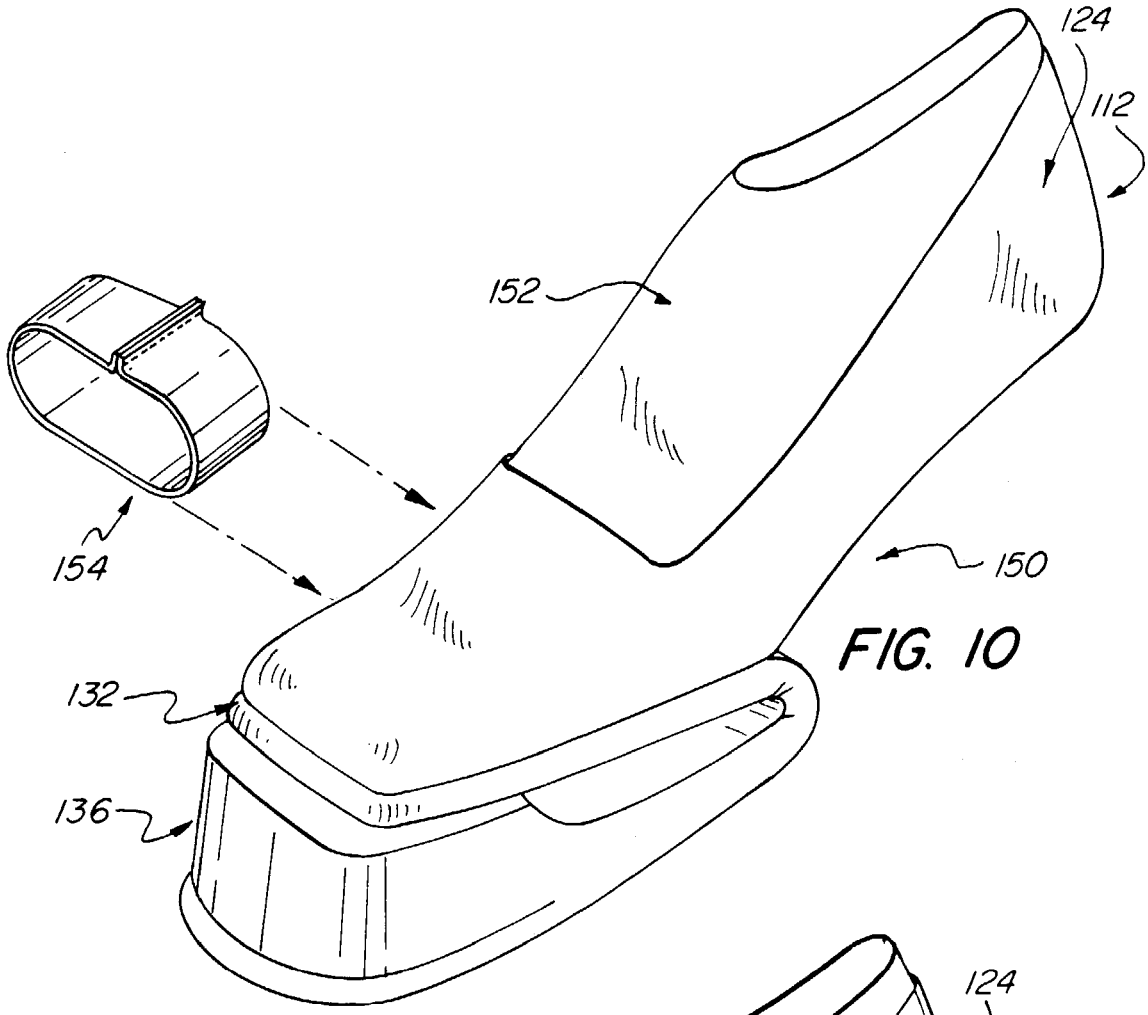
FIG. 10 shows the forepart of the outsole unit of FIG. 9 bent and to be held in place by an elastic retaining band.

Referring to FIG. 10, the tuckboard 116 as shown in FIG. 5 is stapled to the underside of a last 152, which is then inserted into the turned upper configuration 150 for tightly shaping the upper 112 over the contour of the last. The last 152, usually made of a piece of wood or synthetic material, roughly follows the shape of the foot.

The backpart 136 of the outsole unit 118 is bent to touch the forepart 132 and held in this position by an elastic retaining band 154. In this position, the back portion 124 of the upper 112 is lasted by hand or machine and the staples on the tuckboard 116 is removed. The upper 112 is passed through a heat setting machine to heat shrink the upper against the last 152. To promote good bonding with the outsole 128, the lasted back portion 124 of the upper is roughed appropriately.

Figure 11:
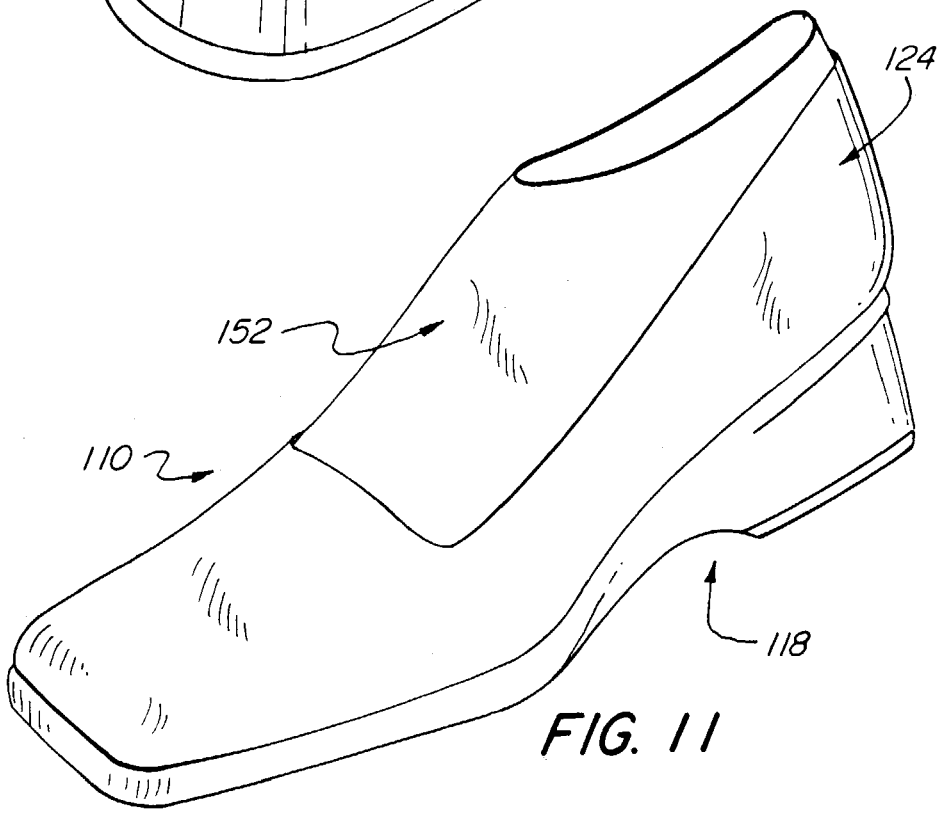
FIG. 11 shows the lasted back portion of the shoe attached to the backpart of the outsole unit of FIG. 10.

Referring to FIG. 11, the elastic retaining band 154 is removed and the outsole unit 118 is cemented to the lasted back portion 124. Finally, the last 152 is removed from the shoe 110 and the footbed 114 is inserted into the internal volume of the shoe.

Figure 12:
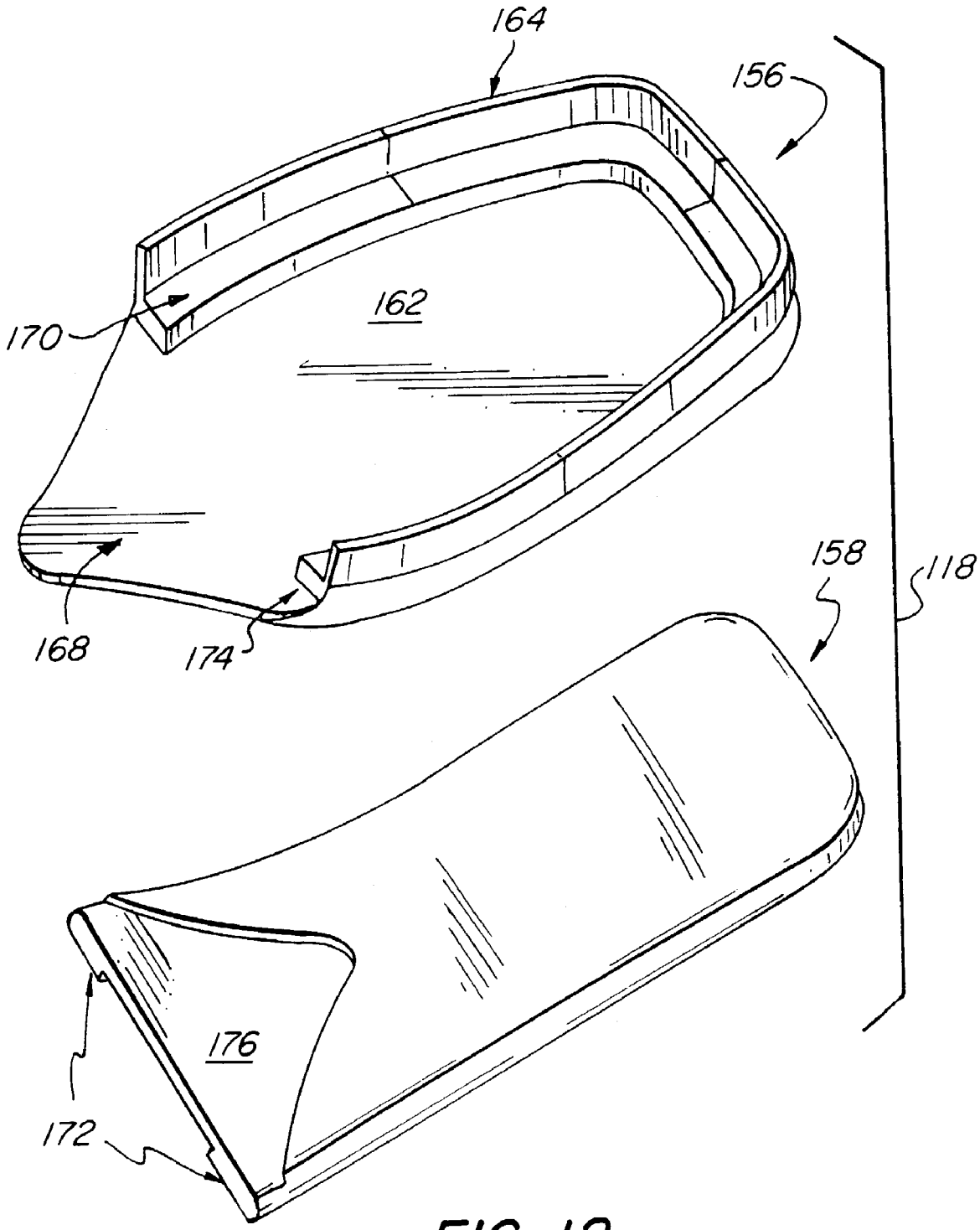
FIG. 12 shows an outsole with a separate forepart and backpart in accordance with another embodiment of the invention.

In the above embodiment, the outsole unit 118 is formed integrally. In another embodiment of the invention, the outsole unit 118 can be formed in two separate parts: a unit forepart 156 and a unit backpart 158. Referring to FIG. 12, the unit forepart 156 includes a bottom 162, which has a standing lip 164 disposed in a "U" shape around the periphery of the bottom and a raised base 170 internally hugging the standing lip. The bottom 162 has a protrusion 168 that extends beyond the top of the "U".

A brake 172 at the end of the unit backpart 158 is made to abut against a buttress 174 at the end of the raised base 170. When the brake and the buttress 174 are in contact, the protrusion 168 of the unit forepart 156 fits into a channel 176, which is a depression formed on the unit backpart 158 and shaped to accommodate the protrusion. The unit backpart 158 is made of polyvinyl chloride or other material that is harder than the unit forepart 156. The unit backpart 158 can be formed integrally with or separately from a heel 160 (FIG. 11), which can e made of wood or another material such as acrylonitrile butadiene styrene resin.

A construction of the shoe 110 with the unit forepart 156 and the unit backpart 158 is described below.

Figure 13:
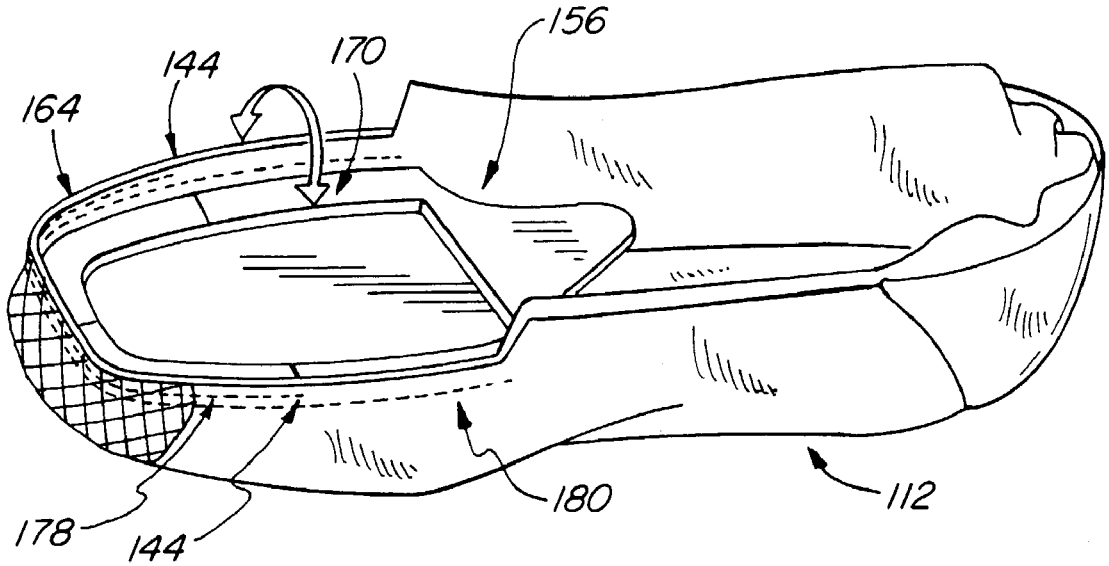
FIG. 13 shows the forepart of FIG. 12 being attached to the upper inside out.
Figure 13:
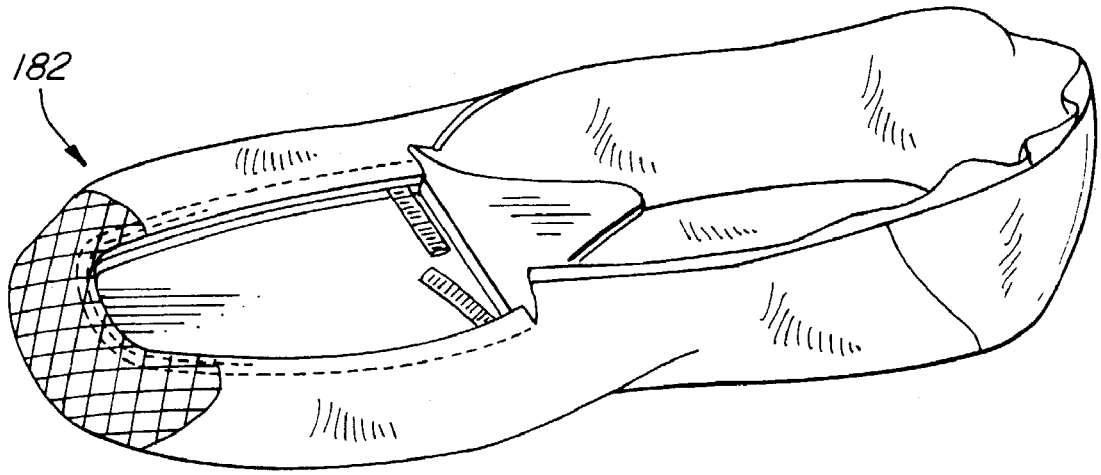

Referring to FIG. 13, the upper 112 is stitched to the standing lip 164 in an inside-out configuration. One row of stitching 178 is made from one side arker 144 to the other side marker 144, going around the periphery of the unit forepart 156. An additional row of stitching 180 is made from one lip end to the other lip end. Then the stitched lip 164 is folded and cemented to the raised base 170. The forepart 156 is then pressed to form a turned-in construction 182.

Figure 14:
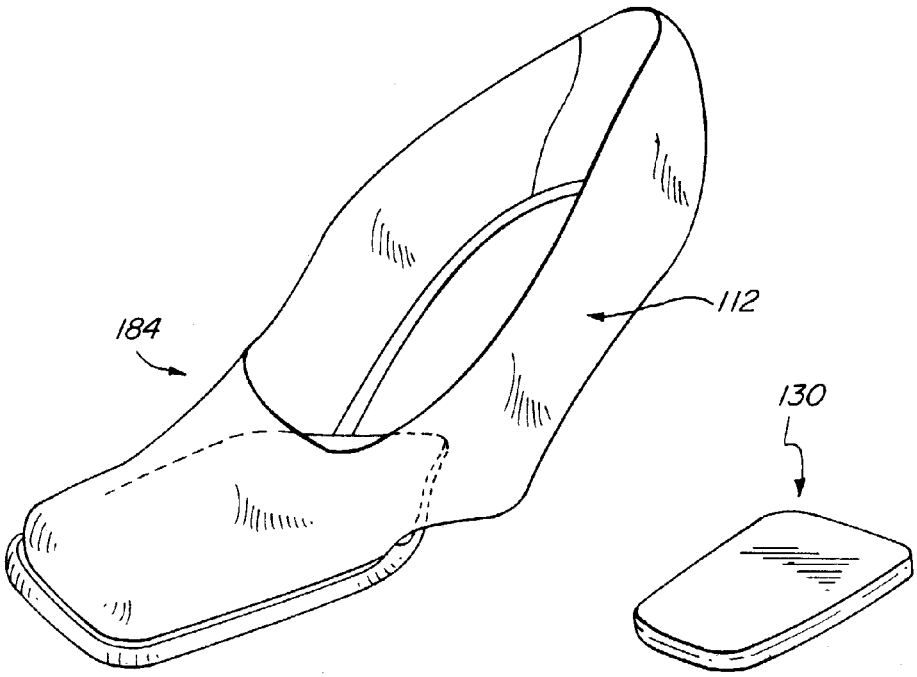
Figure 14:
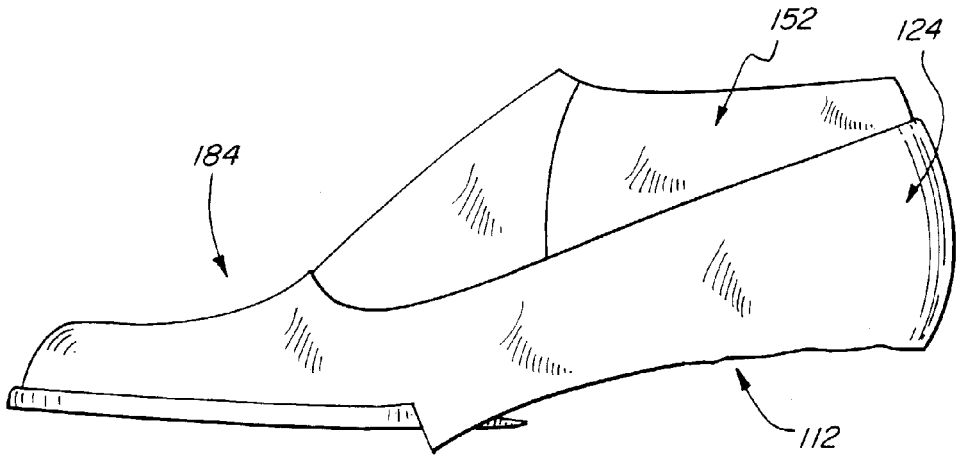

Referring to FIG. 14, the turned-in construction 182 is then turned inside in to form an upper turned-out construction 184 and the forepart filler 130 is inserted into the volume between the unit forepart 156 and the upper 112. A counter stiffener (not shown) and the tuckboard (FIG. 5) are then inserted into the upper turned-out construction 184. The last 152 is then fitted into the volume between the upper 112 and the unit forepart 156. The back portion 124 of the upper 112 is pulled over the last 152.

Figure 15:
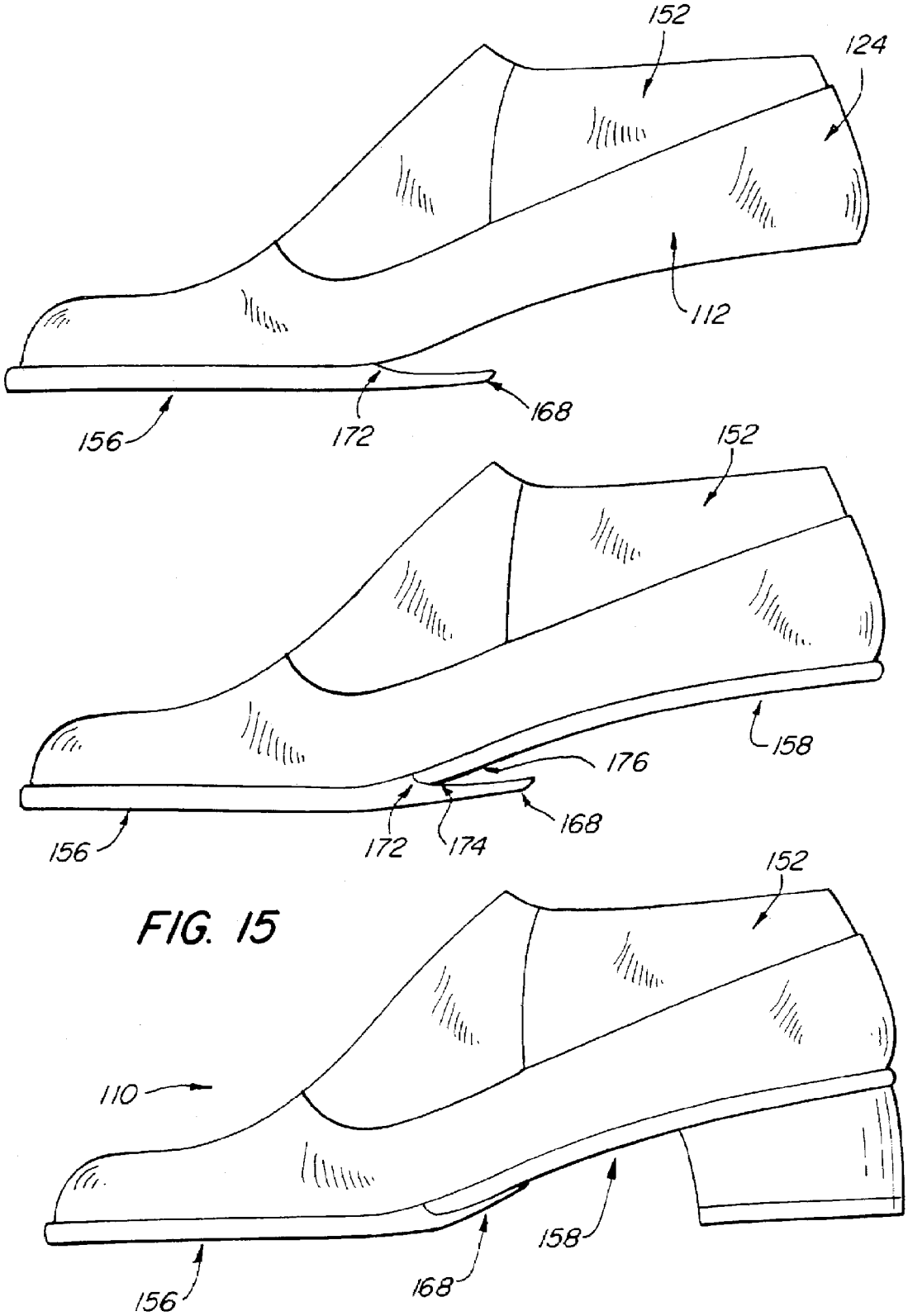
FIG. 15 shows the backpart being attached to the upper and the heel attached to the backpart.

Referring to FIG. 15, the back portion 124 is lasted to conform to the shape of the last 152 and roughed. The brake 174 of the unit backpart 158 is then abutted against the buttress 172 of the unit forepart 156 and the unit backpart 158 is cemented to the upper 112. The protrusion 168 is then attached to the channel 176 of the unit backpart 158. The heel 160 is attached to the bottom of the unit backpart 158. Finally, the last 152 is removed and the footbed 114 (FIG. 5) is inserted in the volume of the shoe 110.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A shoe, comprising:

a one-piece outsole having a heel, a top surface, and a bottom surface;

an anchoring mechanism placed in said heel and having a flattened side and an opposite curved side for conforming with a shape of said heel;

said anchoring mechanism is sized to accommodate at least two fasteners placed between said top surface and said bottom surface;

an upper;

a tuck stitched to said upper; and wherein said tuck is secured to said anchoring mechanism for attaching said upper to said outsole by permitting the at least two fasteners to extend from said upper, through said tuck that is attached to said upper, and to said anchoring mechanism for securing said upper to said outsole.

2. The shoe according to claim 1, wherein the shoe includes a single anchoring mechanism and at least two fasteners.

3. The shoe according to claim 1, further comprising a lip protruding upwardly from said top surface and extending around at least one localized area of a pe-riphery of said top surface for maintaining a position of said upper relative to said out-sole.

4. The shoe according to claim 3, further comprising a stitch for securing said upper to said lip and wherein said anchoring mechanism is a block of material embedded within said outsole and with all surfaces of said anchoring mechanism following an interior contour of a heel of said outsole.

5. The shoe according to claim 3, wherein said at least one localized area is a front portion of said top surface.

6. The shoe according to claim 3, wherein said at least one localized area is a back portion of said top surface.

7. The shoe according to claim 3, wherein said at least one localized area is an entire periphery of said top surface.

8. The shoe according to claim 1, wherein said outsole forms an enclosure about said anchoring mechanism.

9. The shoe according to claim 1, wherein said top surface is bowed shape for defining a recess in said outsole for maintaining a position of said upper relative to said outsole.

10. The shoe according to claim 1, wherein said upper further includes a tuck, said fastener extends through said tuck to said anchoring mechanism for securing said upper to said outsole.

11. A shoe, comprising:

a one-piece outsole having, a heel, a top surface, and a bottom surface;

an anchoring mechanism placed in said heel and having a flattened size and an opposite curved side for conforming with a shape of said heel;

said anchoring mechanism is sized to accommodate at least two fasteners placed between said top surface and said bottom surface;

an upper;

a tuck stitched to said upper;

said tuck extending over a portion of said top surface;

a lip protruding upwardly from said top surface and extending around at least one localized area of a periphery of said top surface for maintaining a position of said upper relative to said outsole;

wherein said tuck is secured to said anchoring mechanism for attaching said upper to said outsole by permitting the at least two fasteners to extending from said upper through said tuck to said anchoring mechanism for securing said upper to said outsole; and wherein said at least two fasteners pass through said tuck and a portion of said outsole and penetrates said anchoring mechanism.

12. The shoe according to claim 11, wherein said top surface is bowed shape for defining a recess in said outsole for maintaining a position of said upper relative to said outsole.

13. A method for providing a shoe, comprising the steps of:

providing one-piece outsole having a heel, a top surface, and a bottom surface;

placing an anchoring mechanism in the heel between the top surface and the bottom surface;

flattening one side of the anchoring mechanism and curving an opposite side of the anchoring mechanism for conforming with a shape of the heel;

sizing the anchoring mechanism to accommodate at least two fasteners;

stitching an upper to a tuck;

securing the upper to the outsole by attaching the tuck to the anchoring mechanism by permitting at least two fasteners to extend from the upper, through the tuck, and to the anchoring mechanism for connecting the upper to the outsole.

14. The method according to claim 13, further comprising the step of enclosing the outsole about the anchoring mechanism.

15. The method according to claim 13, further comprising the step of protruding a lip upwardly from the top surface and extending the lip around at least one localized area of a periphery of the top surface for maintaining a position of the upper relative to the outsole.

16. The method according to claim 13, further comprising the step of bowing the top surface for defining a recess in the outsole for maintaining a position of the upper relative to the outsole.

* * * * *